United States Patent [19]

Johnson et al.

[11] Patent Number: 4,748,705

[45] Date of Patent: Jun. 7, 1988

[54] FLAME RESISTANT POLYESTER/COTTON FABRIC AND PROCESS FOR ITS PRODUCTION

[75] Inventors: James R. Johnson, McLeansville; Chumpon Sujarit, High Point, both of N.C.

[73] Assignee: Burlington Industries, Inc., Greensboro, N.C.

[21] Appl. No.: 23,372

[22] Filed: Mar. 9, 1987

Related U.S. Application Data

[63] Continuation-in-part of Ser. No. 870,892, Jun. 5, 1986.

[51] Int. Cl.[4] ..... D06M 9/00

[52] U.S. Cl. ..... 8/115.7; 8/115.57; 8/115.61; 8/115.64; 8/115.65; 427/393.3; 428/265

[58] Field of Search ..... 8/115.57, 115.61, 115.64, 8/115.65, 115.7

[56] References Cited

U.S. PATENT DOCUMENTS 4,066,812 1/1978 Kaupin ..... 428/265
4,494,951 1/1985 Cole et al. ..... 8/195

OTHER PUBLICATIONS

"Chemical Processing of Fibers and Fabrics"-Functional Finishes, Part B, vol. 2, (Marcel Dekker), 1984, pp. 108–141.

"Flame-retardant Polymeric Materials", (Plenum), 1975, pp. 212–221.

American Dyestuff Reporter, 1968, 57, pp. 40–44.

*Primary Examiner*—A. Lionel Clingman

*Attorney, Agent, or Firm*—Nixon & Vanderhye

[57] ABSTRACT

Flame resistance is imparted to high polyester content (50%) polyester/cotton blend fabrics by the successive application of a cyclic phosphonate ester flame retardant followed by THP/urea precondensate/$NH_3$ and then by THPS. Commercially acceptable, flame retarded polyester/cotton products with improved hand result.

9 Claims, 1 Drawing Sheet

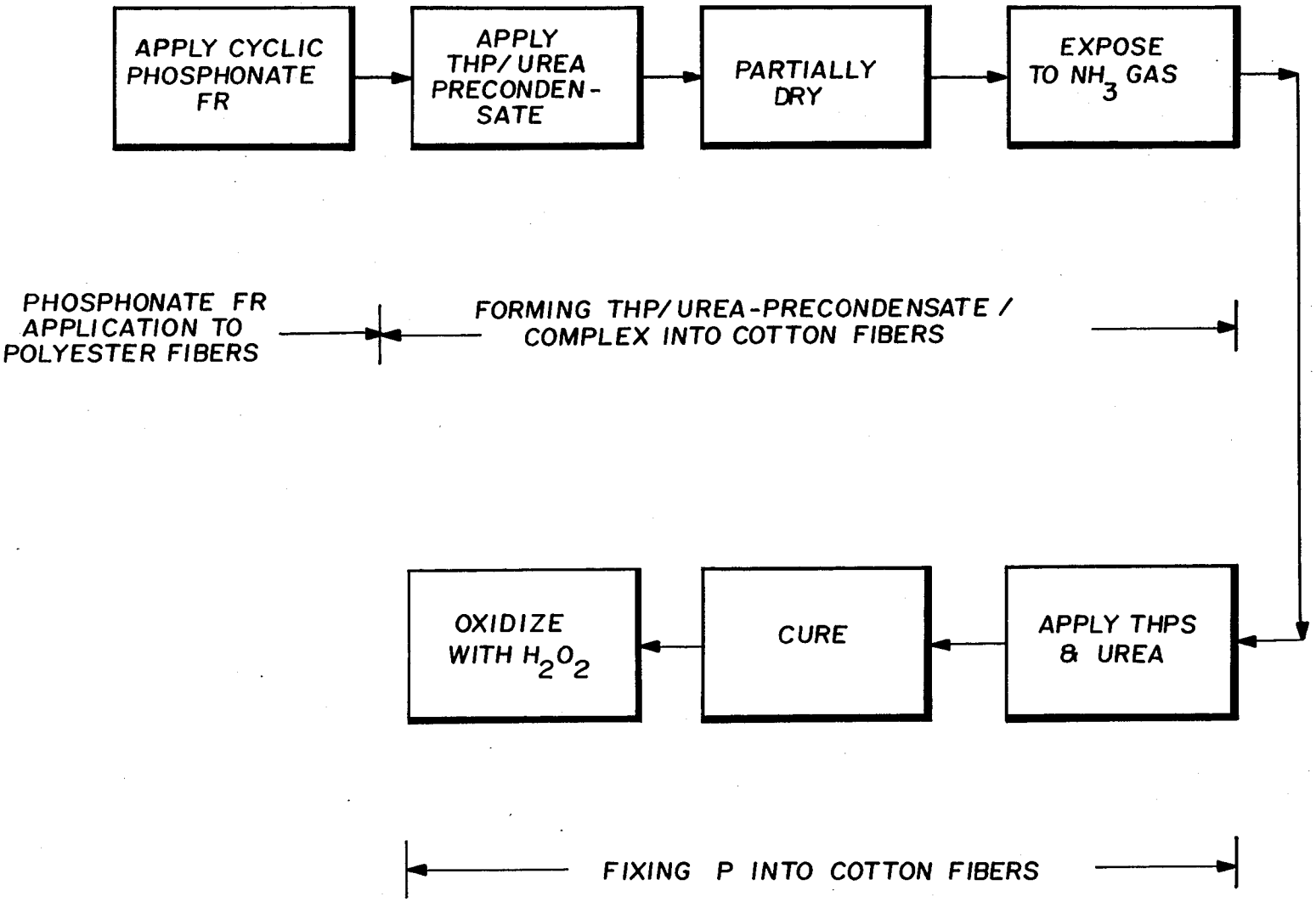
APPLY CYCLIC PHOSPHONATE FR
APPLY THP/UREA PRECONDEN-SATE
PARTIALLY DRY
EXPOSE TO $NH_3$ GAS
PHOSPHONATE FR APPLICATION TO POLYESTER FIBERS
FORMING THP/UREA-PRECONDENSATE / COMPLEX INTO COTTON FIBERS
OXIDIZE WITH $H_2O_2$
CURE
APPLY THPS & UREA
FIXING P INTO COTTON FIBERS

FLAME RESISTANT POLYESTER/COTTON FABRIC AND PROCESS FOR ITS PRODUCTION

CROSS-REFERENCE TO RELATED APPLICATIONS

This application is a continuation-in-part of earlier application Ser. No. 870,892, filed June 5, 1986 in the name of James R. Johnson and assigned to the owners of the present application.

FIELD OF THE INVENTION

This invention relates to a process for imparting flame-retardant properties to polyester/cotton blended fabrics and to fabrics so prepared. The process employs three flame-retardant systems, one specific to the polyester component and two specific to the cotton component. Fabrics having improved hand and increased durability through multiple launderings are so obtained.

BACKGROUND OF THE INVENTION

Prior attempts to achieve acceptable flame-retarded polyester/cotton blends have not met with commercial success. None of the treatments is practical from the consumer point of view, producing fabrics that have a very stiff hand. This is because in order to achieve the requisite flame-retardant properties, a high chemical add-on is required. This add-on makes the fabric stiff, masks the color of the underlying fabric, and often imparts an acrid or unacceptable odor to the fabric. In addition, the performance of the flame-retardant fabrics is often unreliable.

Most of the previous work conducted on flame-retardant polyester/cotton blends used a single chemical system that was targeted for the cotton component of the blend. The approach was to "load" the fabrics with a fire-retardant specific for cotton, for instance THPS [tetrakis-(hydroxymethyl)phosphonium sulfate]. It was not unusual with these earlier products to use from 30 to 35% of fixed chemical add-on in order for the polyester/cotton blend fabric to pass a bottom vertical flame test. Regrettably, however, the aesthetics of the finished fabrics were poor, as they had a very stiff hand and the appearance of a coated fabric. The add-ons used for these products were far in excess of the theoretically required amounts.

The application of THP/urea-precondensate/ammonia or THPOH/ammonia has been used commercially for a number of years. The process consists of applying the precondensate to cotton fabric and drying the fabric to about 10 wt. % moisture. The precondensate is insolubilized by the ammonia inside the cotton fibers. Fixation of the precondensate must take place inside of the cotton fiber to be durable through multiple launderings. However, attempts made in the past to use this process to finish polyester/cotton fabric have not been successful when the polyester fiber content was greater than about 10 weight percent.

While there is an upper limit for the amount of the flame-retardant chemical that can be packed in the cotton fiber, techniques can be used to maximize that amount. It is generally believed that approximately 3 wt % phosphorus in the form of the THP/urea-precondensate/ammonia complex can be fixed inside of the cotton fiber; however, the actual amount will depend on the prior history of the cotton fiber. Fixation of the FR polymer inside the cotton fibers provides no protection to the polyester fibers. Therefore, the polyester fibers still need an additional chemical treatment to provide adequate flame resistance to the polyester/cotton fabric.

It has now been found that the hand and durability of polyester/cotton blend fabrics can be further improved by applying the THP/urea-precondensate/ammonia treatment after the application of a flame retardant specific to the polyester component, which protects the polyester fibers, and prior to the application of THPS/urea which is also used to protect the cotton fiber.

When THPS is applied to a polyester/cotton blend, it is generally believed that about 3% of fixed phosphorus in the form of the THP/urea-precondensate/ammonia complex is required to achieve flame-resistance results. Since the THPS is specific to the cotton, it does not react with the polyester content of the fabric but simply physically coats the polyester. As a result, after multiple launderings, that portion of the flame-retardant surrounding the polyester fiber is partially lost. In consequence, it was not unusual to use as much as 5.5% phosphorus add-on for a polyester/cotton blend, at least initially, in order to result in the target 3% of fixed phosphorus after 50 launderings in hot water.

In the 1970's, polyester/cotton blends were flame retarded using tris-2,3-dibromopropyl phosphate ("Tris") in combination with THPS. However, "Tris" was found to be a carcinogen and was withdrawn from the market, so that there is no predominantly-polyester blend of polyester and cotton sold today that has been treated with flame-retardant chemicals.

The textile literature contains references generally describing the use of two specific flame retardants for a blend of fibers, one for each component of the blend. It is reported that various approaches to the treatment of polyester/cotton blend fabrics have not been commercially accepted.

The flame-resistant polyester/cotton fabric of the present invention exhibits an improved hand and increased durability over multiple launderings and as such represents an improvement over the process described in commonly-assigned application Ser. No. 870,892 filed June 5, 1986, the disclosure of which is hereby incorporated by reference.

The object of this invention is to produce a flame-resistant polyester/cotton blend fabric having improved durability and hand by means of a multiple step application process, an intermediate step to maximize the location of the FR chemicals inside the cotton fibers in order that enough total phosphorus for good flame resistance and durability can be added to the polyester/cotton blend while, at the same time, producing a FR polyester/cotton fabric which has a greatly improved hand over the prior art.

An object of the present invention is to produce acceptable flame-resistant polyester/cotton blends using multiple flame-retardant chemicals or chemical systems in a specific sequence, and to employ processing conditions or adjuvants that produce a commercially acceptable, attractive product having good color, acceptable hand and commercially acceptable durability through multiple launderings.

BRIEF DESCRIPTION OF THE DRAWING

FIG. 1 is a flow chart illustrating the sequential operating steps, and the procedures for certain steps, according to preferred aspects of the invention. Abbreviations, chemicals, processing times, conditions and the like are described in the detailed information that follows. The object of a particular subcombination of steps is given in the horizontal lines below the flow chart.

BRIEF DESCRIPTION OF THE INVENTION

The process of the present invention employs three flame-retardant (FR) systems, one specific to the polyester component and two specific to the cotton component of the polyester/cotton blends in order to maximize the amount of flame retardant inside the cotton fibers. With this approach, the amount of the individual flame-retardants required to satisfy flame-resistant standards can be reduced significantly, and the resulting fabrics have not only better flame-resistant characteristics, but also better aesthetics.

The polyester/cotton fibrous materials which can be provided with a flame-retardant finish according to the invention can be in any desired stage of processing, i.e., they can be treated as woven or knitted fabrics, dyed or undyed, or as textiles which have already been further processed.

DETAILED DESCRIPTION OF THE INVENTION

The invention disclosed herein has several aspects which, for convenience, are illustrated in the drawing and are summarized according to the following scheme:

Treating the Polyester Component of the Blend

Flame-resistant properties are first imparted to the polyester component of the blend using a cyclic phosphonate ester flame-retardant. Processing conditions, especially temperatures and humidities, are carefully controlled in order to optimize the use of the FR chemicals and to ensure good fixation to the polyester/cotton blends, even after several launderings.

Flame-resistant polyester/cotton blend fabrics are prepared in a series of operations conducted in the order or sequence stated. In overview, they are: A. attaching a phosphorus-containing flame retardant to the polyester fibers, B. positioning a predetermined minimum amount of a phosphorus flame retardant inside of the cotton fibers, and C. increasing the flame resistance of the cotton fibers by fixing an additional quantity of phosphorus onto the cotton fibers. Each of these procedures is known individually, but they have not, to our knowledge, been combined in the three-step sequence herein discussed, prior to our invention. Similar flame-retardant polyester/cotton blend fabrics containing at least 20% polyester exhibiting both good hand and sufficient durability to withstand at least 50 wash and dry cycles together with the requisite flame-retardant properties, have not been available.

The polyester/cotton blends treated in accordance with the present invention contain between 20% and 85% of polyester, the balance being cotton.

The term "polyester" is used in its usual sense to mean highly polymeric, essentially linear polyester resins made by the reaction of a dicarboxylic acid or ester with a diol in the presence of an esterification or ester interchange catalyst. Illustrative dicarboxylic acids are malonic, succinic, adipic, azelaic, maleic, fumaric, hydromuconic, isophthalic, terephthalic, and cyclohexane-dicarboxylic acids. Representative diols are ethylene glycol, propylene glycol, butylene glycol and 1,6-hexanediol. See U.S. Pat. Nos. 2,465,319 and 2,901,446. The common commercial polyester resins are polyethylene terephthalate and polyethylene terephthalate modified by including of minor proportions of a different glycol or dicarboxylic acid during the polyesterification process. The polyester used in the working examples that follow was polyethylene terephthalate.

Flame-resistant properties are imparted to the fabric in three distinct steps, one for the synthetic (polyester or nylon) component of the blend and two additional steps for the cotton component of the blend. The order in which these steps are conducted is critical to achieve optimum results. With this in mind, the specific procedures of this process are now described.

Treating the Cotton Component of the Synthetic/-Cotton Blend.

Flame-resistant properties are imparted to the cotton component of the synthetic/cotton blend in a two step procedure first in an "ammonia cure" process by impregnating the fabric with carefully measured quantity of a tetrakis-(hydroxymethyl) phosphonium salt/urea precondensate, referred to as THPS when the salt is the sulfate $[(HOCH_2)_4P^+]_2\ SO_4^=$ is the chloride; the oxalate and phosphate salts are also known. The THP salt-/urea precondensate is applied to the fabric typically as an aqueous solution and dried to a specific moisture level. It is then reacted on the fabric with ammonia, usually ammonia gas, under controlled conditions to form an ammoniated flame retardant which, to achieve additional fixation, is oxidized, usually with hydrogen peroxide, to form a three-dimensional flame-retardant polymer network within the cotton fiber structure.

Currently there are two THP-based flame-retardant systems marketed for this type of treatment. Pyroset TPO is a THPS/urea precondensate of tetrakis-(hydroxymethyl) phosphonium sulfate and urea available from American Cyanamid Co., while Retardol AC is a THPC/urea prepolymer condensate of tetrakis-(hydroxymethyl)phosphonium chloride and urea available from Albright & Wilson. Pyroset TPO is recommended by its manufacturer for treating cellulosic fabric or blends containing at least 65% cellulosic fiber.

The process of imparting flame resistance to 100% cotton fabrics using THPC/urea precondenste (Retardol AC) is known as the PROBAN process as licensed by Albright & Wilson. The process itself is described in the following U.S. Pat. Nos. 4,078,101; 4,145,463; 4,311,855; and 4,494,951, all to Albright & Wilson, the disclosures of which are hereby incorporated by reference to the extent necessary to explain the THP salt-/urea precondensate process. See also U.S. Pat. No. 4,346,031 to Elgal et al. This process is considered effective and is widely promoted by at least two companies for imparting flame resistance to 100% cotton fabrics; it is not promoted or advertised for polyester/cotton blends or nylon/cotton blends. The THP salt/urea precondensate process by itself is ineffective to adequately protect polyester/cotton blends containing more than about 35 to 40% polyester.

Placement of the flame retardant into and onto the cotton fibers is maximized and durability to multiple launderings improved with a second flame-retardant system also specific to the cotton component of the blend. This second system employs a mixture of tetrakis(hydroxymethyl) phosphonium sulfate (THPS, as in the previous step) mixed with urea which mixture, when heated, forms an insoluble polymer, containing both phosphorus and nitrogen, inside of the cotton fibers and around the cotton and synthetic fibers. The insolubility of this polymer is increased further by oxidizing the phosphorus with hydrogen peroxide. THPS is sold by Albright & Wilson as Retardol S.

The hand of the treated fabrics can be improved by conducting the curing operation in a moist, high-humidity environment. This procedure not only imparts an improved hand to the treated fabric, but it also causes better fixation of the FR chemicals so that the desirable FR properties are retained even after multiple launderings.

Among the fire-retardant materials used in accordance with the present invention are thermally stable cyclic phosphonate esters prepared by reacting alkyl-halogen-free esters with a bicyclic phosphite. As a class, these cyclic phosphonate esters are represented by one of the formulas:

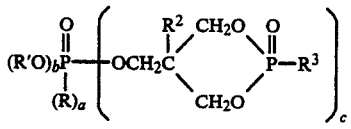

(A)

where a is 0 or 1; b is o, 1 or 2, c is 1, 2 or 3 and a+b+c is 3; R and R' are the same or different and are alkyl ($C_1$–$C_8$), phenyl, halophenyl, hydroxyphenyl, tolyl, xylyl, benzyl, phenethyl, hydroxyethyl, phenoxyethyl, or dibromophenoxymethyl; $R^2$ is alkyl ($C_1$–$C_4$); and $R^3$ is lower alkyl ($C_1$–$C_4$) or hydroxyalkyl ($C_1$–$C_4$) or

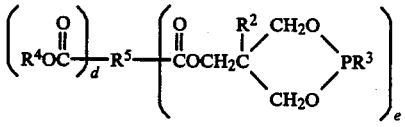

(B)

where d is 0, 1 or 2; e is 1, 2 or 3; $R^2$ is alkyl ($C_1$–$C_4$); $R^3$ is lower alkyl ($C_1$–$C_4$) or hydroxyalkyl ($C_1$–$C_4$); $R^4$ is alkyl $C_1$–$C_4$ phenyl, halophenyl, hydroxyphenyl, hydroxyethyl phenoxyethyl, dibromophenoxyethyl, tolyl, xylyl, benzyl, or phenethyl; and $R^5$ is monovalent alkyl ($C_1$–$C_6$), chlorophenyl, bromophenyl, dibromophenyl, tribromophenyl, hydroxyphenyl, naphthyl, tolyl, xylyl, benzyl, or phenethyl; divalent alkylene ($C_1$–$C_6$), vinylene, o-phenylene, m-phenylene, p-phenylene, tetrachlorophenylene (o, m, or p), or tetrabromophenylene (o, m, or p); or trivalent phenenyl. The preferred compounds (see below) are represented by the formula:

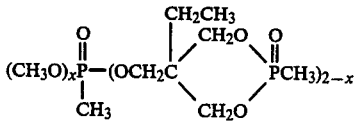

in which X is 0 or 1, and usually a 50:50 mixture of the mono- and di-esters. The preparation of these cyclic phosphonate esters and their use as flame retardants are described in U.S. Pat. Nos. 3,789,091 and 3,849,368, the disclosures of which are hereby incorporated by reference. The use of these cyclic phosphonate esters as flame retardants for treating polyester/cotton and polyester/cellulose triacetate blends is described in U.S. Pat. No. 4,066,812 to the William Carter Company. This patent indicates (column 5, lines 42–47) the phosphonate esters have little or no effect on the cellulose or cotton portion of the blend but does have an effect on the flame resistance of the bland as a whole, particularly when the blend contains 75% or more by weight of polyester.

Antiblaze 19T, as described by the supplier Albright & Wilson Inc., of Richmond, Va., is a cyclic phosphonate ester, available as an odorless viscous liquid (viscosity 6000 SMS at 100° F.) with a flashpoint of 340° F. (ASTM D-93).

Tetrakis-(hydroxymethyl)phosphonium sulfate (THPS), also available from Albright & Wilson, Inc., under the name Retardol S, is a pale, straw-colored liquid that is miscible with water and has a pungent odor.

Flame-Resistance Testing Methods—the following testing procedures were used:

FR Federal Test Method 5903 is intended for use in determining the resistance of cloth to flame and glow propagation and tendency to char. A rectangular cloth test specimen (70 mm×120 mm) with the long dimension parallel to the warp or fill direction is placed in a holder and suspended vertically in a cabinet with the lower end ¾ inch above the top of a Fisher gas burner. A synthetic gas mixture consisting primarily of hydrogen and methane is supplied to the burner. After the specimen is mounted in the cabinet and the door closed, the burner flame is applied vertically at the middle of the lower edge of the specimen for 12 seconds. The specimen continues to flame after the burner is extinguished. The time in seconds the specimen continues to glow after the specimen has ceased to flame is reported as afterglow time; if the specimen glows for more than 30 seconds, it is removed from the test cabinet, taking care not to fan the glow, and suspend in a draft-free area in the same vertical position as in the test cabinet. Char length, the distance (in mm) from the end of the specimen, which was exposed to the flame, to the end of a lengthwise tear through the center of the charred area to the highest peak in the charred area, is also measured. Five specimens from each sample are usually measured and the results averaged.

EXAMPLE 1

Seven polyester/cotton fabrics having blend ratios ranging from 40/60 to 65/35 polyester/cotton were selected for a series of tests. Antiblaze 19 (15% solution) was padded onto each fabric at a wet pickup of from 18 to 28.8%, calculated on the weight of the fabric (owf), then cured for 90 seconds at 360° F. to fix this cyclic phosphonate to the polyester fibers. Following this, the fabric samples were finished with one of two levels of THP/urea-precondensate and one of two levels of THPS/urea. The pad bath in the last step (involving the application of THPS/urea) included 3% of a reactive silicone softener, Ultratex HX-33, a product of the Ciba-Geigy Company. The THPS/urea precondensate was Pyroset TPO (American Cyanamid) which after padding onto the fabric for a wet pickup ranging from 15 to 22% owf was heated at 130° F. for 48 seconds to reduce the moisture content to a level of about 10%, exposed to ammonia gas at 6:1 ammonia:phosphorus mole ratio, then oxidized with a hydrogen peroxide/sodium silicate solution.

Table I reports the results in terms of phosphorus fixation and retention after laundering. In this Table, the amounts by weight of polyester/cotton are indicated as a fraction under the name of the fabric. "h.w" indicates heavy weight; "l.w." indicates light weight. The amount of phosphorus fixed to the fabric after the THPS/urea precondensate treatment is indicated in the first column adjacent the sample column; the amount of phosphorus fixed to the fabric following the THPS treatment is indicated in the second column. Four runs were made for each type of fabric; runs were in pairs with equal amounts of the THP/prepolymer in the first pair and a greater amount of THPS in the second run of the first pair. Each sample was laundered 50 times and the amount of phosphorus remaining fixed to the fiber reported. The percentage of phosphorus remaining on the fiber after 50 launderings as compared with the percent phosphorus on the fabric prior to laundering is reported as percent efficiency in the last column. These two columns are a measure of the durability of the flame-retardant finish to multiple launderings.

The fabrics were subjected to flame-resistance testing according to FR Federal Test Method 5903. Three different samples of each fabric type were used, laundered for 40, 50 and 60 times and fibers in the fill (F) and warp (W) direction were subjected to FR 5903. Four samples corresponding to the four of Table I were tested and the results of 12 tests averaged and reported in Table II. If one or more of the samples burned the entire length, the number of samples is indicated with an integer and reported as the top half of the fraction; the char length (in in.) of the samples that completed the test was averaged.

Phosphorus analyses were made for each sample as prepared, reported in the order given (left to right) of "P found"—percent phosphorus found after the THPS/urea precondensate treatment; "P found"—percent phosphorus found after the THPS treatment; "P,50x"—percent phosphorus after 50 hot washings; and "Eff"—percent of phosphorus after 50 launderings compared with the amount of phosphorus after the THPS treatment.

TABLE I

| Sample | Pfound % | Pfound % | P50x % | Eff % |
|---|---|---|---|---|
| Cottington | 1.74 | 3.3 | 2.58 | 78 |
| twill h.w. | 1.74 | 3.8 | 3.05 | 80 |
| 40/60 | 2.05 | 3.4 | 2.91 | 86 |
| | 2.05 | 4.0 | 2.53 | 63 |
| Cottington | 1.89 | 3.4 | 3.22 | 94 |
| twill l.w. | 1.89 | 3.9 | 3.29 | 84 |
| 40/60 | 1.92 | 3.4 | 2.72 | 80 |
| | 1.92 | 4.0 | 3.27 | 82 |
| Gauntlet | 1.94 | 3.5 | 2.94 | 84 |
| h.w. | 1.94 | 3.9 | 3.28 | 84 |
| 50/50 | 2.06 | 3.3 | 2.87 | 87 |
| | 2.06 | 3.8 | 3.17 | 83 |
| Indestructable | 1.34 | 2.9 | 2.61 | 90 |
| h.w. | 1.34 | 3.4 | 2.68 | 79 |
| 65/35 | 1.07 | 2.5 | 1.78 | 71 |
| | 1.07 | 3.1 | 2.29 | 74 |
| Bandmaster | 1.40 | 3.0 | 2.63 | 88 |
| 65/35 | 1.40 | 3.6 | 2.63 | 80 |
| | 1.42 | 2.8 | 2.37 | 85 |
| | 1.42 | 3.4 | 2.79 | 82 |
| Concept | 1.33 | 3.3 | 2.61 | 79 |
| l.w. | 1.33 | 3.8 | 2.75 | 72 |
| 65/35 | 1.39 | 2.9 | 2.20 | 76 |
| | 1.39 | 3.5 | 2.51 | 72 |
| Utopia | 1.30 | 2.7 | 1.99 | 74 |
| l.w. | 1.30 | 3.6 | 2.78 | 77 |
| 65/35 | 1.18 | 2.9 | 2.15 | 74 |
| | 1.18 | 3.5 | 2.19 | 63 |

EXAMPLE 2

A 65/35 polyester/cotton fabric was processed as in Example 1. Phosphorus retention and flame resistance data were determined after 30, 50 and 80 wash/dry cycles as shown in Table III. The destination "BEL" indicate the sample burned the entire length of samples in the test. As with the previous Table, char length is the average of the 4 samples tested.

TABLE II

| Fabric | Wash cycles | F = Fill/ W = Warp | Samples A1 | A2 | B1 | B2 |
|---|---|---|---|---|---|---|
| 1 | 40x | F | 3.7 | 3.8 | 3.7 | 3.8 |
| | | W | 4.0 | 4.2 | 3.9 | 3.8 |
| | 50x | F | 4.3 | 3.6 | 3.4 | 3.5 |
| | | W | 4.4 | 3.9 | 4.1 | 3.9 |
| | 60x | F | 3.8 | 3.6 | 3.8 | 3.7 |
| | | W | 4.2 | 4.1 | 5.0 | 4.3 |
| 2 | 40x | F | 3.3 | 3.4 | 3.7 | 3.4 |
| | | W | 4.0 | 3.9 | 3.6 | 3.9 |
| | 50x | F | 3.6 | 3.1 | 3.2 | 3.4 |
| | | W | 4.2 | 3.7 | 4.3 | 4.2 |
| | 60x | F | 3.4 | 3.2 | 3.9 | 3.1 |
| | | W | 4.2 | 3.7 | 4.3 | 3.9 |
| 3 | 40x | F | 3.8 | 3.6 | 4.6 | 3.8 |
| | | W | 4.5 | 3.8 | 4.2 | 4.0 |
| | 50x | F | 4.3 | 3.7 | 1BEL*/4.5 | 4.0 |
| | | W | 4.5 | 4.1 | 5.5 | 3.8 |
| | 60x | F | 4.3 | 3.4 | 1BEL/4.8 | 4.0 |
| | | W | 5.0 | 4.1 | 5.0 | 4.4 |
| 4 | 40x | F | 1BEL/5.6 | 4.5 | 3BEL/5.9 | 2BEL/4.7 |
| | | W | 1BEL/4.6 | 5.2 | 3BEL/7.1 | 1BEL/5.2 |
| | 50x | F | 2BEL/4.8 | 5/0 | 4BEL/5.8 | 5.0 |
| | | W | 4BEL/5.6 | 5.0 | 6BEL | 4BEL/5.2 |
| | 60x | F | 4BEL/5.8 | 2BEL/4.6 | 6BEL | 1BEL/4.6 |
| | | W | 6BEL | 2BEL/4.8 | 6BEL | 2BEL/4.9 |
| 5 | 40x | F | 5.5 | 4.5. | 6.6 | 4.6 |
| | | W | 2BEL/5.4 | 5.2 | 3BEL/5.7 | 2BEL/5.0 |
| | 50x | F | 2BEL/5.1 | 4.4 | 6BEL | 5.7 |
| | | W | 3BEL/4.2 | 4.7 | 4BEL/6.0 | 2BEL/5.8 |
| | 60x | F | 6BEL | 4.5 | 2BEL/6.3 | 4.5 |
| | | W | 3BEL/6.7 | 2BEL/5.0 | 6BEL | 1BEL/4.7 |
| 6 | 40x | F | 1BEL/5.1 | 4.6 | 4BEL/6.9 | 1BEL/4.5 |
| | | W | 2BEL/5.7 | 5.2 | 6BEL | 6.0 |
| | 50x | F | 2BEL/5.7 | 4.6 | 2BEL/5.4 | 4.4 |
| | | W | 3BEL/4.9 | 4.8 | 3BEL/7.1 | 1BEL/4.9 |

TABLE II-continued

| Fabric | Wash cycles | F = Fill/ W = Warp | Samples A1 | A2 | B1 | B2 |
|---|---|---|---|---|---|---|
| | 60x | F | 3BEL/5.2 | 4.2 | 3BEL/7.3 | 3BEL/4.7 |
| | | W | 3BEL/4.8 | 1BEL/4.6 | 4BEL/6.7 | 4BEL/5.8 |
| 7 | 40x | F | 3BEL/4.7 | 4.6 | 6.1 | 6.2 |
| | | W | 3BEL/6.1 | 5.0 | 2BEL/6.2 | 2BEL/6.1 |
| | 50x | F | 1BEL/4.8 | 4.8 | 3BEL/6.7 | 2BEL/6.1 |
| | | W | 5BEL/8.0 | 4.8 | 2BEL/6.9 | 1BEL/4.9 |
| | 60x | F | 4BEL/5.8 | 1BEL/4.6 | 5BEL/7.4 | 2BEL/4.7 |
| | | W | 6BEL | 4.6 | 5BEL/7.1 | 4.6 |

*BEL = burned entire length

EXAMPLE 3

A 40/60 polyester/cotton fabric was processed as in Example 1. Phosphorus and flame resistance data are given in Table IV.

TABLE III

| TPO % owf | THPS % owf | Total Actual % P | 30x % P | 5903 C.L. Pass | 50x % P | 5903 C.L. Pass | 80x % P | 5903 C.L. Pass |
|---|---|---|---|---|---|---|---|---|
| 12.9 | 14.6 | 2.4 | 2.0 | BEL | 2.0 | BEL | 2.0 | 5.8 ¾ |
| 17.0 | 19.2 | 2.9 | 2.6 | 5.0 ¾ | 2.6 | 5.6 ¾ | 1.7 2.5 | 5.4 ¾ |
| 17.0 | 19.2 | 3.2 | 2.6 | 5.4 | 2.6 | 5.0 | 2.1 2.7 | 6.2 2/4 |
| 16.6 | 26.6 | 3.4 | 2.9 | 4.1 | 2.9 | 5.0 | 2.1 3.0 | 5.2 ¾ |
| 17.2 | 26.6 | 3.4 | 3.1 | 4.5 | 3.0 | 5.2 | 2.3 3.2 | 5.0 |
| 18.8 | 22.6 | 3.3 | 3.0 | 4.5 | 3.0 | 4.8 | 2.5 3.1 | 5.1 |
| 18.8 | 22.6 | 3.5 | 3.1 | 4.3 | 3.1 | 4.4 | 2.3 3.2 | 5.2 |
| 19.0 | 13.8 | 2.7 | 2.3 | 5.5 ¾ | 2.3 | 5.3 | 2.3 2.1 | 7.8 ¼ |
| 19.7 | 31.6 | 3.7 | 3.4 | 4.0 | 3.1 | 4.5 | 1.9 3.3 | 5.4 |
| 19.4 | 22.6 | 3.4 | 3.1 | 4.1 | 3.2 | 4.9 | 2.6 3.0 | 5.1 |
| 19.1 | 22.6 | 3.4 | 3.1 | 4.6 | 3.1 | 4.5 | 3.5 3.3 | 5.3 |
| 18.9 | 22.6 | 3.4 | 3.2 | 4.0 | 3.1 | 4.5 | 2.7 3.1 | 5.1 |
| 22.2 | 19.2 | 3.3 | 2.8 | 4.6 | 2.7 | 5.1 | 2.4 2.4 | 5.5 |
| 21.6 | 19.2 | 3.5 | 2.8 | 4.3 | 2.9 | 5.0 | 2.2 2.9 | 5.2 |
| 22.5 | 26.6 | 3.7 | 3.2 | 4.7 | 3.0 | 4.6 | 2.2 3.1 | 5.1 |
| 21.5 | 26.6 | 3.5 | 3.2 | 4.6 | 3.2 | 4.8 | 2.5 3.1 | 5.1 |
| 27.0 | 22.6 | 3.4 | 3.1 | 4.4 | 3.0 | 4.8 | 2.4 2.9 2.5 | 5.1 |

TABLE IV

| TPO % owf | THPS % owf | Total Actual % P | 30x % P | 5903 C.L. Pass | 50x % P | 5903 C.L. Pass | 80x % P | 5903 C.L. Pass |
|---|---|---|---|---|---|---|---|---|
| 9.1 | 19.8 | 2.3 | 2.1 | 4.0 ¼ | 2.0 | 5.5¾ | 2.1 | BEL |
| 14.4 | 15.9 | 2.5 | 2.2 | 4.1 | 2.3 | 4.8 ¾ | 2.0 2.2 | 5.2 ¾ |
| 14.4 | 15.9 | 2.5 | 2.1 | 4.9 | 2.2 | 5.3 ¾ | 1.8 2.4 | 4.9 |
| 14.4 | 21.3 | 2.7 | 2.6 | 4.3 | 2.5 | 4.3 | 2.0 2.5 | 5.1 |
| 14.4 | 21.3 | 2.8 | 2.6 | 4.4 | 2.5 | 4.7 | 2.2 2.4 | 4.4 |
| 18.0 | 19.8 | 2.9 | 2.7 | 4.8 | 2.6 | 4.2 | 2.2 2.8 | 4.3 |
| 18.0 | 19.8 | 3.0 | 2.6 | 4.3 | 2.5 | 4.7 | 2.2 2.8 | 4.8 |
| 18.0 | 11.0 | 2.5 | 2.2 | 5.4 ¾ | 2.2 | 4.8 ¾ | 2.2 2.2 | 5.5 2/4 |

TABLE IV-continued

| TPO % owf | THPS % owf | Total Actual % P | 30x % P | 5903 C.L. Pass | 50x % P | 5903 C.L. Pass | 80x % P | 5903 C.L. Pass |
|---|---|---|---|---|---|---|---|---|
| | | | | | | | 1.8 | |
| 18.0 | 26.0 | 3.4 | 3.2 | 3.8 | 3.1 | 4.2 | 3.1 | 3.9 |
| | | | | | | | 2.8 | |
| 18.0 | 19.8 | 3.0 | 2.9 | 4.0 | 2.8 | 4.1 | 2.9 | 3.9 |
| | | | | | | | 2.5 | |
| 18.0 | 19.8 | 3.1 | 2.8 | 4.2 | 2.8 | 4.3 | 2.9 | 4.3 |
| | | | | | | | 2.4 | |
| 18.0 | 19.8 | 3.2 | 2.9 | 3.5 | 2.8 | 4.2 | 3.2 | 4.5 |
| | | | | | | | 2.4 | |
| 21.9 | 15.9 | 3.0 | 2.7 | 4.1 | 2.6 | 4.3 | 2.9 | 5.0 |
| | | | | | | | 2.3 | |
| 21.9 | 15.9 | 3.1 | 2.8 | 3.8 | 2.7 | 4.7 | 2.7 | 5.0 |
| | | | | | | | 2.3 | |
| 21.9 | 21.3 | 3.3 | 3.1 | 3.7 | 2.9 | 4.3 | 3.1 | 4.7 |
| | | | | | | | 2.6 | |
| 21.9 | 21.3 | 3.2 | 3.1 | 3.9 | 2.9 | 4.4 | 3.4 | 4.8 |
| | | | | | | | 2.5 | |
| 27.3 | 26.0 | 3.9 | 3.7 | 3.6 | 3.5 | 4.2 | 3.3 | |

What is claimed is:

1. A process for imparting flame resistance to a polyester/cotton blend fabric containing at least about 40% by weight polyester, comprising the successive steps of:

(1) applying to a polyester/cotton blend fabric a flame-retarding amount of a cyclic phosphonate ester represented by the formula:

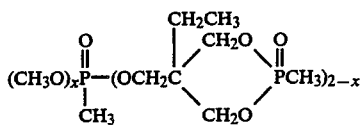

in which x is 0 or 1, that fixes onto the polyester fibers;

(2) applying to the fabric a flame-retarding amount of a prepolymer condensate of urea and a tetrakis(hydroxymethyl)phosphonium salt flame retardant that fixes to the cotton fibers, exposing the prepolymer condensate-containing fabric to a source of ammonia to form an ammoniated prepolymer of tetrakis(hydroxymethyl)phosphonium salt/urea to form a flame-retardant polymer network within the cotton fiber structure; and (3) applying an additional flame-retarding amount of a tetrakis(hydroxymethyl)phosphonium sulfate and urea to the fabric, heating the fabric to form an insoluble phosphorus-containing polymer in and on the cotton fibers and oxidizing the fabric with hydrogen peroxide to further improve the flame resistance imparted by the phosphorus, steps (1), (2), and (3) conducted in the order stated.

2. The process of claim 1 in which the fabric contains 40% to 85% by weight polyester, balance substantially entirely cotton.

3. The process of claim 2 in which the fabric is a 40/60 polyester/cotton blend.

4. The process of claim 2 in which the fabric is a 65/35 polyester/cotton blend.

5. The process of claim 2 in which the fabric is a 50/50 polyester/cotton blend.

6. The process of claim 1 in which the tetrakis(hydroxymethyl)phosphonium salt is the chloride salt.

7. The process of claim 1 in which the tetrakis(hydroxymethyl)phosphonium salt is the sulfate salt.

8. The process of claim 1 in which the tetrakis(hydroxymethyl)phosphonium salt is the oxalate salt.

9. The process of claim 1 in which the tetrakis(hydroxymethyl)phosphonium salt is the phosphate salt.

* * * * *